US007699561B2

(12) United States Patent
McCann et al.

(10) Patent No.: US 7,699,561 B2
(45) Date of Patent: Apr. 20, 2010

(54) METHOD AND SYSTEM FOR STORING LIQUID IN A GEOLOGICAL FORMATION

(75) Inventors: Dominic McCann, Paris (FR); Rolf Hermann, Hannover (DE)

(73) Assignee: Schlumberger Technology Corporation, Sugar Land, TX (US)

( * ) Notice: Subject to any disclaimer, the term of this patent is extended or adjusted under 35 U.S.C. 154(b) by 646 days.

(21) Appl. No.: 10/561,640

(22) PCT Filed: Jun. 14, 2004

(86) PCT No.: PCT/EP2004/051107

§ 371 (c)(1),
(2), (4) Date: Mar. 13, 2007

(87) PCT Pub. No.: WO2004/113627

PCT Pub. Date: Dec. 29, 2004

(65) Prior Publication Data

US 2008/0047326 A1 Feb. 28, 2008

(30) Foreign Application Priority Data

Jun. 20, 2003 (EP) ..... 03291517

(51) Int. Cl.
*E03B 3/32* (2006.01)

(52) U.S. Cl. ..... 405/52; 166/250.15; 405/53

(58) Field of Classification Search ..... 405/52, 405/53; 166/245, 252.3, 250.15
See application file for complete search history.

(56) References Cited

U.S. PATENT DOCUMENTS 3,768,555 A 10/1973 Levens
6,412,555 B1 7/2002 Sten-Halvorsen et al.

FOREIGN PATENT DOCUMENTS

GB 1112955 5/1968

OTHER PUBLICATIONS

ASR—UK: Elucidating the Hydrogeological Issues Associated With Aquifer Storage and Recovery in the UK; Gale, I N. Williams, et al. 2002, British Geological Survey.*
Integrated Aquifer Characterization and numerical simuation for an aquifer storage and recharge at Marco Lakes Florida; Herrmann, et al. 2004.*
International Search Report for PCT/EP2004/051107 dated Oct. 20, 2004 (1 page).

* cited by examiner

*Primary Examiner*—John Kreck
(74) *Attorney, Agent, or Firm*—Osha • Liang LLP

(57) ABSTRACT

A method for improving the recovery efficiency of storing fresh water into an aquifer, the storing includes injecting the fresh water and extracting the injected fresh water by a single water storage system that includes at least one well penetrating into the aquifer, the method includes: providing a plurality of screens, each screen being located alongside a wall of at least one well, and each screen respectively allowing a flow of fresh water between an associated storage zone in contact with the screen and the well on which the screen is located; controlling the flow of fresh water through each one of the plurality of screens according to parameters provided from a storage model of the aquifer, the storage model describing a behavior of each storage zone.

23 Claims, 10 Drawing Sheets

METHOD AND SYSTEM FOR STORING LIQUID IN A GEOLOGICAL FORMATION

BACKGROUND OF INVENTION

1. Field of the Invention

The invention relates generally to storing of a liquid into a geological formation.

2. Background Art

Storing of a liquid into a geological formation is a common practice, and may be used for example for storing fresh water. The geological formation may for example be an aquifer, i.e. a water bearing stratum of permeable rock, sand or gravel.

The storing of fresh water in an aquifer may be economically more competitive than using tanks, and more particularly surface tanks. This is particularly true when relatively large quantities of water need to be stored for an uncertain amount of time, e.g. in a context of strategic storage. The aquifer is simply used as a reservoir into which the fresh water is placed. This water can be used later: for example in case a normal water providing process is interrupted, or when a drier period occurs and large quantities of water are required, the stored fresh water may be withdrawn. A pump is then placed at the well and the stored fresh water is extracted.

FIG. 1 show a schematic illustration of a water storage system using an aquifer according to prior art. A screen 11 with slots 17 is located on a wall of a well 12 penetrating into the aquifer 13. The slots of the screen enable a flow of liquid. In case fresh water is to be stored in the aquifer, the fresh water is injected from the surface into the well 12 and flows through the screen 11. The fresh water is injected using a pump or any other means as appropriate. The injected fresh water creates a water bubble, i.e., a zone 14 of fresh water inside of the aquifer 13 and extending away from the screen 11. A part of the aquifer surrounding the zone 14 contains native aquifer water. The native water may for example be brackish water 15, i.e. water containing salts. The native water tends to be pushed aside as the volume of the stored fresh water increases.

In the following description it will be assumed as an example that the native water is brackish water.

In case the fresh water is to be extracted from the aquifer, the fresh water flows from the zone 14 through the screen 11 to the surface by flowing inside the well 12. The water is generally pumped to the surface by using a pump placed inside the well. A sensor 16 is used to measure a quality parameter of the extracted water at a level of the surface. The measurements from sensor 16 are used to monitor the quality of the water. Usually the quality of the fresh water may be affected by salt providing from the brackish water 15, or from any other contaminate that is present. This may happen after a part of the stored fresh water has been retrieved and a mixture of fresh water and brackish water created at the border of the zone 14 starts being extracted.

FIG. 2 illustrates an example of a plot of the quality parameter versus time during the extraction of fresh water in the system from FIG. 1. The quality parameter may be a Total Dissolved Salt (TDS) content, or any other parameter used to define water quality. Generally a suitable zone is found so that the fresh water does not move much in the aquifer after it has been injected and during the time in which it is stored. Therefore, at the beginning of extraction, the quality of the extracted fresh water is close to the quality of the injected fresh water: the TDS content has relatively low values as can be seen at the left of the curve in FIG. 2 around the time t0.

As the water continues to be extracted and time increases, the TDS content rises. After a relatively large amount of the injected fresh water has been extracted from the aquifer, the extracted liquid contains an increasing amount of brackish water and the TDS content raises. The TDS content reaches a pre-defined threshold at the time t1. The pre-defined threshold may for example correspond to a maximum tolerable TDS for fresh water. The extraction is then stopped.

The injection of fresh water and its extraction up to a pre-defined TDS content corresponds to an injection-extraction cycle. The injection-extraction cycle may be repeated several times, i.e. the aquifer and its water storing system may be re-used.

A recovery efficiency parameter is defined as a ratio of the volume of extracted water to the volume of injected water during any one cycle. The recovery efficiency parameter increases with the number of injection-extraction cycles. FIG. 3 contains an example curve illustrating the increase of the recovery efficiency parameter. The recovery efficiency parameter is plotted versus the number of injection-extraction cycles. In this example, at the first injection-extraction cycle, the recovery efficiency parameter has a value of about 42%. The efficiency parameter increases with each subsequent cycle and reaches 72% at the end of the fifth injection-extraction cycle.

Often the fresh water is stored seasonally so a cycle may represent 1 year.

In a further embodiment of a water storage system know from prior art, a plurality of wells may be provided. Each well addresses a distinct area of the same aquifer. For each well, the injection-extraction cycle is performed, independently of the other wells. FIG. 4 illustrates an example of a water storage system using a plurality of wells, in which the surface is viewed from above, i.e. from the sky. Each of the wells 42 is represented by a large dot. Each well 42 is used to inject and extract fresh water. As a result of this an extended zone 44 of fresh water is obtained in the aquifer. The fresh water zone 44 is represented by a white surface and is in fact located under the surface in the geological formation. Hatched surfaces represent brackish water under the surface. Hatched surfaces 45 surrounding the fresh water zone 44 represent a transition zone of the aquifer containing brackish water and fresh water, partly mixed.

Further hatched surfaces that are represented as limited surfaces inside the fresh water zone 44 illustrate traps of brackish water 49: these may appear between the wells 42 as a result of operating the wells 42 independently from each other during the injection and extraction of fresh water. During the time that the fresh water is stored in the aquifer, the traps of brackish water 49 may deteriorate the quality of the zone of fresh water 44, thus causing a loss in recovery efficiency.

Similarly, during extraction, each well is used to extract fresh water independently of the other wells. In some cases fresh water located between the wells may not be extracted by any well, thus creating traps of fresh water. This causes a loss of fresh water and reduces the recovery efficiency.

SUMMARY OF INVENTION

In a first aspect the invention provides a method for storing a liquid into a geological formation using at least one well penetrating into the geological formation The geological formation comprises at least one storage zone. The method comprises providing a plurality of screens, each screen being located alongside a wall of at least one well, and each screen respectively allowing a flow of liquid between an associated storage zone in contact with the screen and the well on which the screen is located. The method further comprises controlling the flow of liquid through each one of the plurality of screens according to parameters providing from a storage model of the geological formation, the storage model describing a behavior of each storage zone.

In a first preferred embodiment the method further comprises monitoring a quality parameter of the liquid, triggering a selecting step if the quality parameter reaches a critical value, selecting a determined screen following the triggering; and modifying the flow of liquid through the determined screen.

In a second preferred embodiment the method further comprises providing the plurality of screens, each screen being located alongside the wall of a single well.

In a third preferred embodiment the method further comprises extracting the liquid from the geological formation, and monitoring the quality parameter of the liquid at an exit of the single well. Following the triggering an open screen is selected, the open screen being located as the deepest open screen alongside the single well among all open screens of the plurality of screens. The flow of liquid through the selected open screen is stopped.

In a fourth preferred embodiment the method comprises positioning a seal inside the single well in proximity of the selected screen, to stop the flow of liquid through the selected screen.

In a fifth preferred embodiment the method further comprises extracting the liquid from the geological formation and monitoring the quality parameter of the liquid at each screen of the plurality of screens. An open screen is selected following the triggering, the screen corresponding to a location alongside the single well at which the quality parameter reaches the critical value, and the flow of liquid through the selected open selected screen is stopped.

In a sixth preferred embodiment the method comprises activating a closing mechanism at the selected screen, to stop the flow of liquid through the selected screen.

In a seventh preferred embodiment the method further comprises injecting the liquid into the geological formation through a first screen, the first screen being located as the deepest screen alongside the single well, and monitoring the quality parameter of liquid at an outside part of each screen of the plurality of screens distinct from the first screen, the outside part being in contact with a storage zone. A second screen is selected among the plurality of screens following the triggering, the second screen being distinct from the first screen, and the second screen corresponding to a location alongside the single well at which the quality parameter reaches the critical value, and the flow of liquid through the second screen is enabled.

In an eighth preferred embodiment the method further comprises providing a main well, providing at least one peripheral well, the peripheral well being distinct from the main well, and providing at least one screen from the plurality of screens for respectively each one of the main well and the peripheral wells.

In a ninth preferred embodiment the method further comprises injecting the liquid into the geological formation through a screen located alongside the main well, and monitoring the quality parameter of liquid at an outside part of each screen located on a peripheral well, the outside part of each screen being in contact with a storage zone. Following the triggering, a screen is selected at which the quality parameter reaches the critical value, and the liquid is injected into the geological formation through the peripheral well on which the selected screen is located.

Preferably the liquid is fresh water, the geological formation an aquifer, and the quality parameter a total dissolved salt parameter.

In a second aspect the invention provides an apparatus for storing a liquid into at least one storage zone of a geological formation. The apparatus comprises at least one well penetrating into the geological formation, a plurality of screens, each screen being located alongside a wall of at least one well, and each screen respectively allowing a flow of liquid between an associated storage zone in contact with the screen, and a well on which the screen is located, and controlling means to control the flow of liquid through each one of the plurality of screens according to parameters providing from a storage model of the geological formation, the storage model describing a behavior of each storage zone.

In a tenth preferred embodiment the apparatus further comprises a main well, at least one peripheral well, the peripheral well being distinct from the main well, and a sensor system respectively for each peripheral well, the sensor system measuring a value of a quality parameter over the liquid in an associated storage zone of a screen located on the peripheral well.

In an eleventh preferred embodiment the apparatus further comprises a first pump for injecting the liquid into the main well, and a second pump for injecting the liquid into a peripheral well. Processing means receive a signal from the sensor system. The controlling means are triggered to initiate the second pump for a determined peripheral well if the processing means output a signal indicating that the quality parameter at a screen of the determined peripheral well reaches a critical value.

In a twelfth preferred embodiment the apparatus further comprises a main well, at least one peripheral well, the peripheral well being distinct from the main well, and a measuring device to measure a quantity of liquid that passes through the main well and the quantity of liquid that passes through each one of the peripheral well. The controlling means receive a signal from the measuring device and control the flow of liquid according to the signal from the measuring device correlated to the storage model.

In a further preferred embodiment the plurality of screens is located alongside a wall of a single well.

In a thirteenth preferred embodiment the apparatus further comprises a sensor system to measure a quality parameter of the liquid at an exit of the well.

In a fourteenth preferred embodiment the apparatus further comprises a sensor system to measure a quality parameter of the liquid at an exit of the well.

In a fifteenth preferred embodiment the apparatus further comprises a seal allowing to isolate a portion of the well that is located below the seal from a portion of the well that is located above the seal, and operating means for catching and moving the seal inside the well.

In a sixteenth preferred embodiment the apparatus further comprises processing means receiving a signal from a sensor system. The controlling means are triggered to initiate the operating means if the processing means output a signal indicating that the quality parameter passes a critical value, allowing to stop the flow of the liquid through a screen located below the seal.

In a seventeenth preferred embodiment the apparatus further comprises a closing mechanism respectively for each screen to stop the flow of liquid through the screen.

In an eighteenth preferred embodiment the apparatus further comprises processing means receiving a signal from a sensor system. The controlling means are triggered to initiate a determined closing mechanism if the processing means output a signal indicating that the quality parameter passes a critical value.

In a nineteenth preferred embodiment the access means are triggered according to a storage model, the storage model describing a behavior of each storage zone.

In a twentieth preferred embodiment, the method according to the invention comprises injecting the liquid into the geological formation, and extracting the liquid from the geological formation. The selecting and the modifying step are performed such to keep the quality parameter of the liquid being extracted in a desired range. The extracting of the liquid is interrupted if the quality parameter is outside of the desired range.

The injecting, the extracting and the interrupting steps may be repeated in at least one cycle following the interrupting step.

Preferably the interrupting comprises selectively interrupting the extracting from one determined storage zone of the geological formation if the quality parameter from liquid extracted out of the determined zone is outside the desired range.

Other aspects and advantages of the invention will be apparent from the following description and the appended claims.

BRIEF DESCRIPTION OF DRAWINGS

The invention will now be described in greater detail with reference to the accompanying drawings, in which.

DETAILED DESCRIPTION

General Overview

The recovery efficiency of fresh water injected and extracted in a geological formation, e.g. in an aquifer, is generally considered to be relatively low in systems known from prior art, particularly in the early cycles which can last many years. The low recovery efficiency is a cost factor that needs to be taken into consideration when storing "expensive" water or in areas where fresh water scarcity is an issue, e.g. fresh water produced by desalinisation. The issue of increasing the recovery efficiency of the storage becomes an important economical question.

Figure 5:
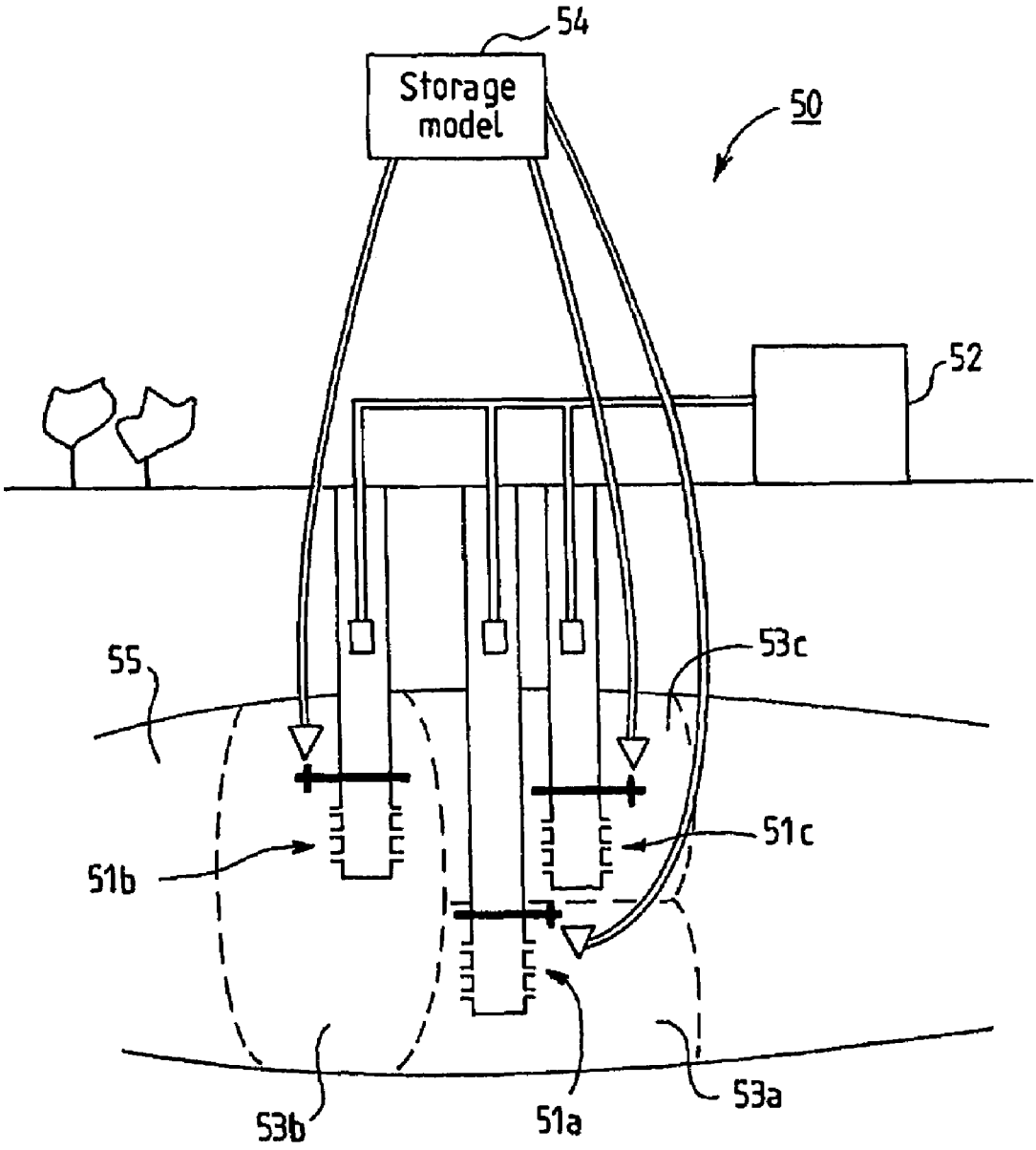
FIG. 5 contains a schematic diagram illustrating an example embodiment of a water storage system according to the invention.

FIG. 5 provides a schematic illustration of a water storage system 50 according to the present invention. The water storage system 50 is shown here as a first example of embodiment. The water storage system 50 may be used to inject fresh water from a base reservoir 52 into an aquifer 55, to store the injected water in the aquifer 55, and to extract the fresh water from the aquifer 55. A plurality of screens 51*a*, 51*b*, 51*c* are located respectively in storage zones 53*a*, 53*b*, 53*c* inside the aquifer 55. Each storage zone is delimited by hatched lines in FIG. 5. Each screen 51*a*, 51*b*, 51*c* allows a flow of liquid between the base reservoir 52 and the respective storage zone 53*a*, 53*b*, 53*c*.

In the example illustrated in FIG. 5 the base reservoir 52 is shown as a tank located at the surface. Other examples such as a lake, a river, or an underground tank may well be used instead of the illustrated base reservoir 52 to gather water outside of the aquifer. Alternatively the water may come directly from a processing plant, e.g. a desalination or treatment plant, or directly from a delivery system and pumped directly into the storage zones.

The storage zones 53*a*, 53*b*, 53*c* are located in proximity of their respective associated screens 51*a*, 51*b*, 51*c*.

The flow of liquid through at least one of the screens 51*a*, 51*b*, 51*c* may be controlled for example by opening and closing a flow connection between the respective storage zone 53*a*, 53*b*, 53*c* and the base reservoir 52. In other words, the flow of liquid to and from a respective storage zone 53*a*, 53*b*, 53*c* may be interrupted or enabled. The opening and closing may be conducted according to a storage model 54 of the geological formation.

The storage model 54 allows to describe a behaviour of each storage zone with respect to the interactions between native water within the zones and the injected fresh water. The storage model 54 may for example describe the following parameters:

a quantity of liquid that may be injected in each storage zone 53*a*, 53*b*, 53*c;* an order of the storage zones 53*a*, 53*b*, 53*c* in which to inject a liquid;

an order of the storage zones 53*a*, 53*b*, 53*c* in which to extract a liquid;

a threshold value or range of a quality parameter related for example to chemical properties of the liquid being extracted;

a shape of the storage zones 53*a*, 53*b*, 53*c;* geological characteristics of the aquifer, such as porosity or constitution;

a density of the brackish water;

a density of the injected liquid.

The storage model 54 may be of empirical nature, i.e. derived from measurement made in the aquifer, or inside the well or at the surface. The storage model may alternatively be derived from a numerical model of the aquifer, requiring input of parameters that describe the aquifer, e.g. volume, density, depth, injected and native water parameters etc. . . . .

The storage model 54 is based on an improved understanding of how liquid injected in the storage zone 53*a*, 53*b*, 53*c* may position itself in the aquifer and behave when it is stored over a duration of time, and extracted from the aquifer. Hence storing and extracting fresh water using the storage model results in an improved injection-extraction efficiency.

Single Well Configuration

Figure 6:
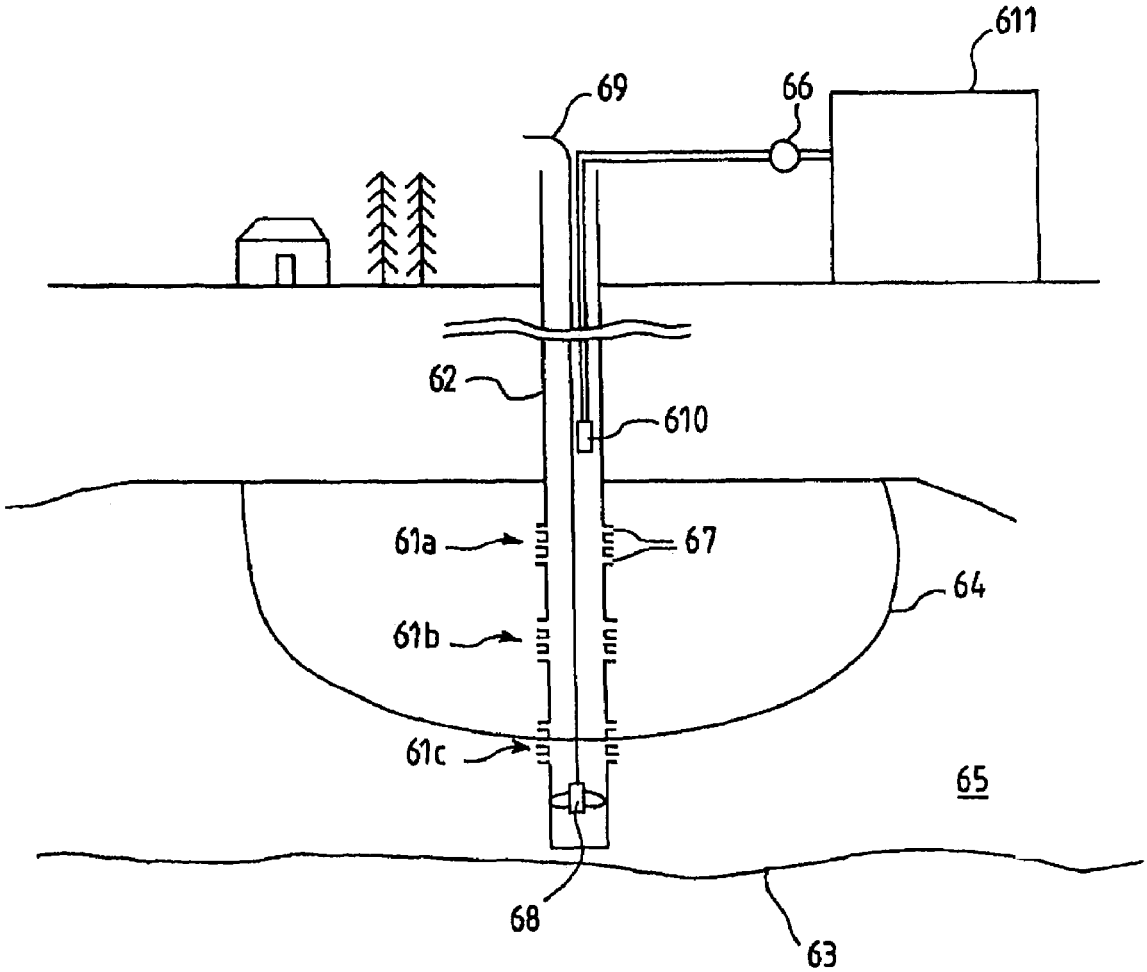
FIG. 6 contains a schematic diagram illustrating an example embodiment of a water storage system comprising a single well according to the invention.

FIG. 6 schematically illustrates a second example embodiment of the present invention. A single well 62 penetrates from the surface into an aquifer 63. A plurality of screens 61*a*, 61*b*, 61*c* having slots 67 are arranged along a longitudinal direction of the well 62. Each screen 61*a*, 61*b*, 61*c* respectively allows the flow of fresh water between a base reservoir 611 and a storage zone that is associated with the screen. The flow may for example be realized using a pump or any other means. The base reservoir 611 is located at the surface. The storage zone associated with a screen is located in proximity of the screen.

An extraction pump 610 allows to pump water out of the well 62.

The storage model describing the behaviour of each storage zone takes into consideration that brackish water 65 has a greater density than the injected fresh water. It is therefore taken into consideration that a zone 64 of fresh water has a tendency to float on top of the brackish water 65. The behaviour of the zone 64 of the injected fresh water and the brackish water 65, i. e. the interaction of these zone during an extended period of time and during extraction, may be simulated in a numerical model to obtain the storage model (e.g., using the ECLIPSE reservoir storage model, using the SEAWAT storage model, using the FEFLOW storage model, etc.).

A sensor 66 is provided for measuring and monitoring the quality parameter, in this example the Total Dissolved Salt (TDS) content. In other examples, and throughout this description, the sensor may be adapted to detect any other pollution parameter as appropriate. The sensor is located at the surface, and the TDS content is measured over the water that is extracted over the whole well 62, i.e. the fresh water flows from the zone 64 through all of the screens 61*a*, 61*b*, 61*c*.

When the measured TDS content increases and reaches a predefined threshold, the deepest located screen, i.e., the screen 61*c* is closed. The decision to close the deepest screen is made with help of the storage model, according to which the brackish water is located under the fresh water, i.e. it is located at a deeper location than the fresh water. When the measured quality parameter reaches the predefined threshold value, it is considered, according to the storage model, that the brackish water contained in the extracted liquid has been extracted on the bottom of or below the zone of fresh water 64.

As a result of closing the deepest screen 61*c*, the extraction continues with water flowing through screens 61*b* and 61*a* only. The screens 61*b* and 61*b* are located in a remaining part of the zone 64 that contains fresh water with a TDS content under the predefined threshold value.

Figure 7A:
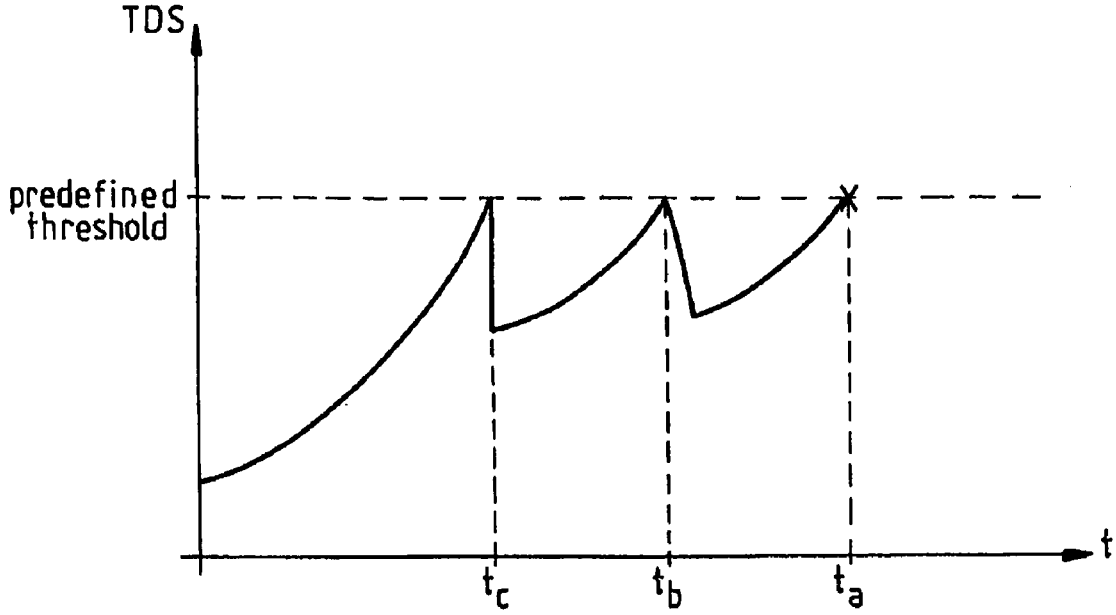
FIG. 7*a* contains an example of a plot of a quality parameter versus time as used in the present invention.

FIG. 7*a* illustrates a plot of the TDS content in the extracted water versus time according to the example embodiment described in relation to FIG. 6. When the measured TDS content reaches the predefined threshold value for the first time at a time TC, the deepest screen 61*ct* is closed.

As a consequence, the TDS content decreases in a first place but increases again during further extraction of fresh water.

As soon as the TDS reaches the predefined threshold value again at a time TB, the deepest screen among the screens that are open is selected to be closed, i.e. the screen 61*b* is closed. The decision to select and close the screen 61*b* is made in accordance with the storage model: it is considered that the zone of fresh water 64 has shrank between times TC and TB, thus allowing a level of the brackish water 65 to rise to the next open screen and eventually to excessively pollute the fresh water being extracted.

The extraction of fresh water continues with water flowing through the screen 61*a* only.

As the TDS content reaches the predefined threshold value again at a time TA, the last screen 61*a* is closed and extraction is stopped.

The single well configuration shown in the present example allows to increase the recovery efficiency of the well as compared to prior art water storage systems, since the extraction goes on even after the TDS content reaches for the first time the predefined threshold value.

Figure 1:
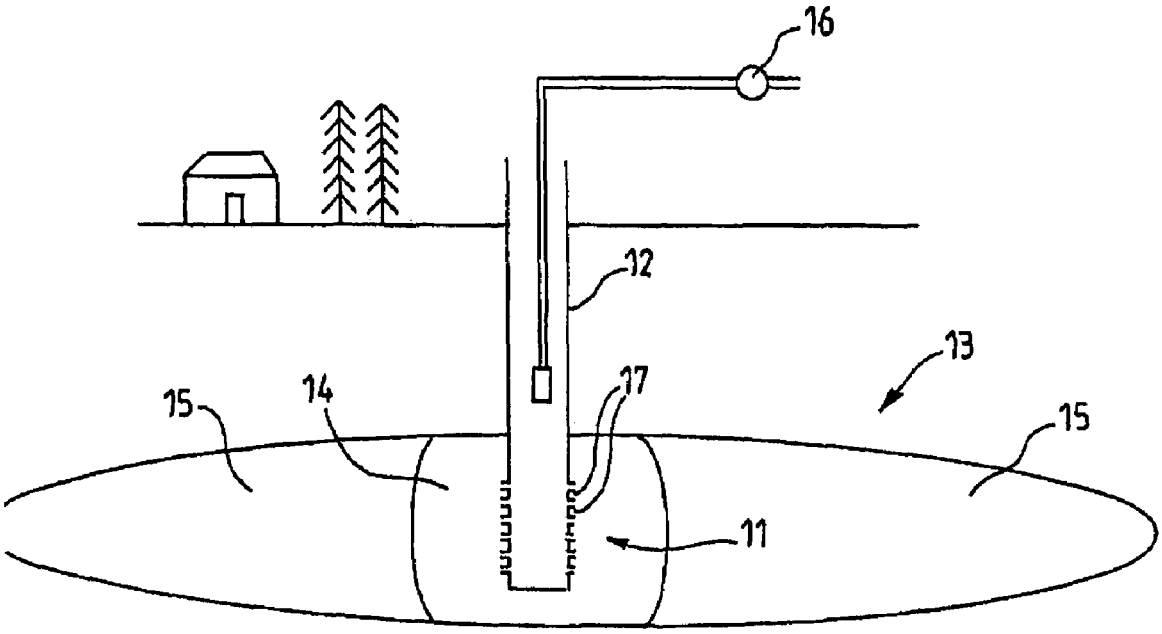
PRIOR ART FIG.1
FIG. 1 contains a schematic illustration of a water storage system from prior art.
Figure 2:
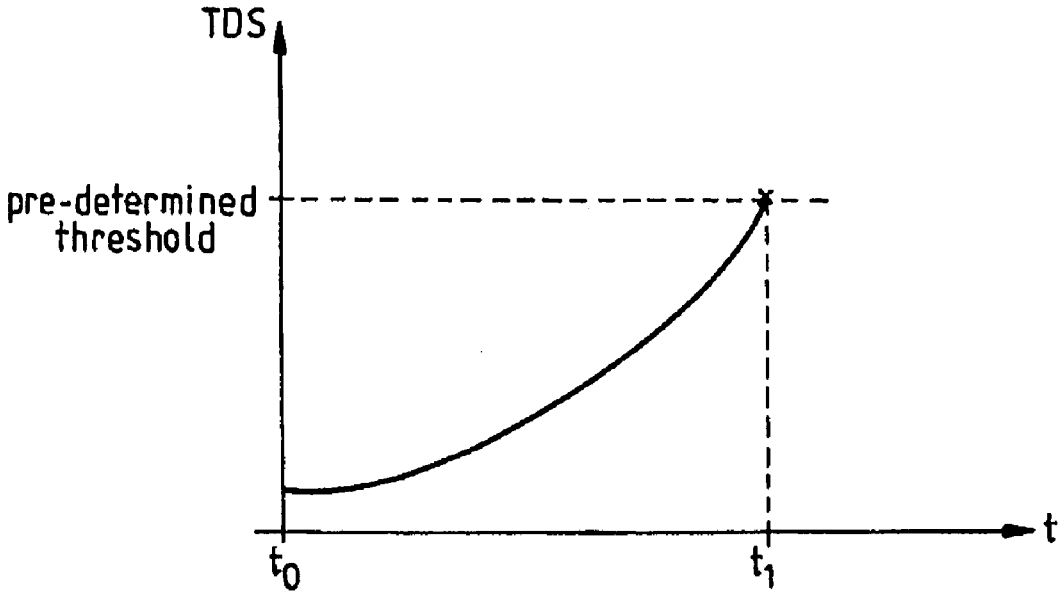
FIG. 2 PRIOR ART
FIG. 2 contains a plot of a quality parameter versus time as known from prior art.
Figure 3:
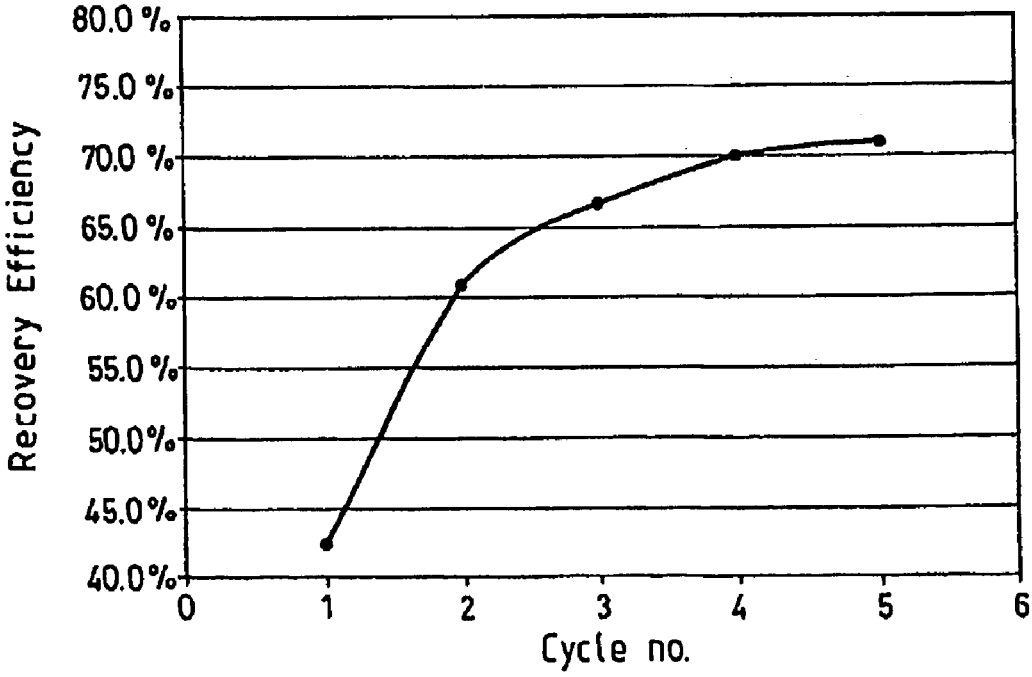
FIG. 3 PRIOR ART
FIG. 3 contains a plot of a recovery efficiency parameter as known from prior art.
Figure 4:
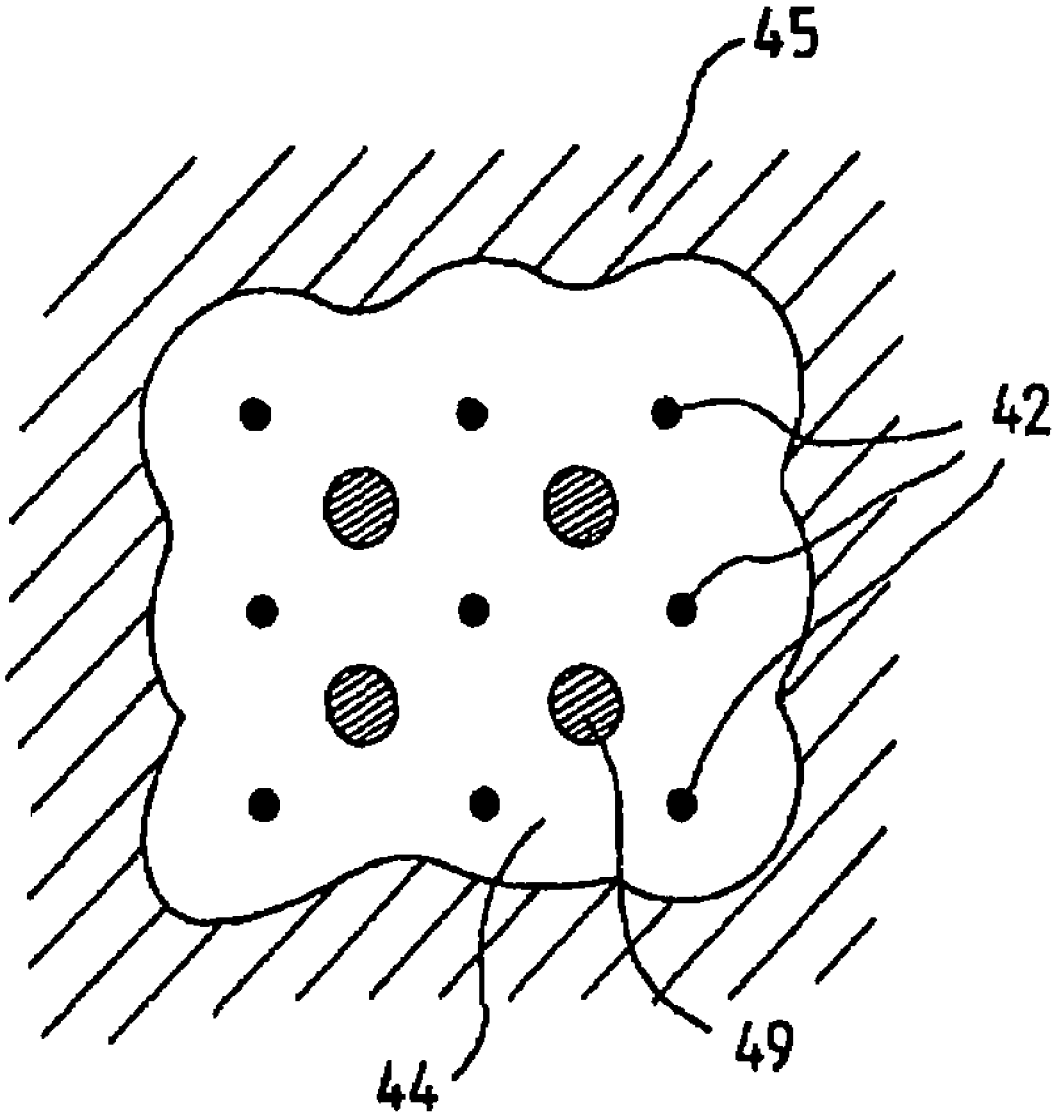
PRIOR ART FIG.4
FIG. 4 contains a schematic illustration of a water storage system from prior art.
Figure 7B:
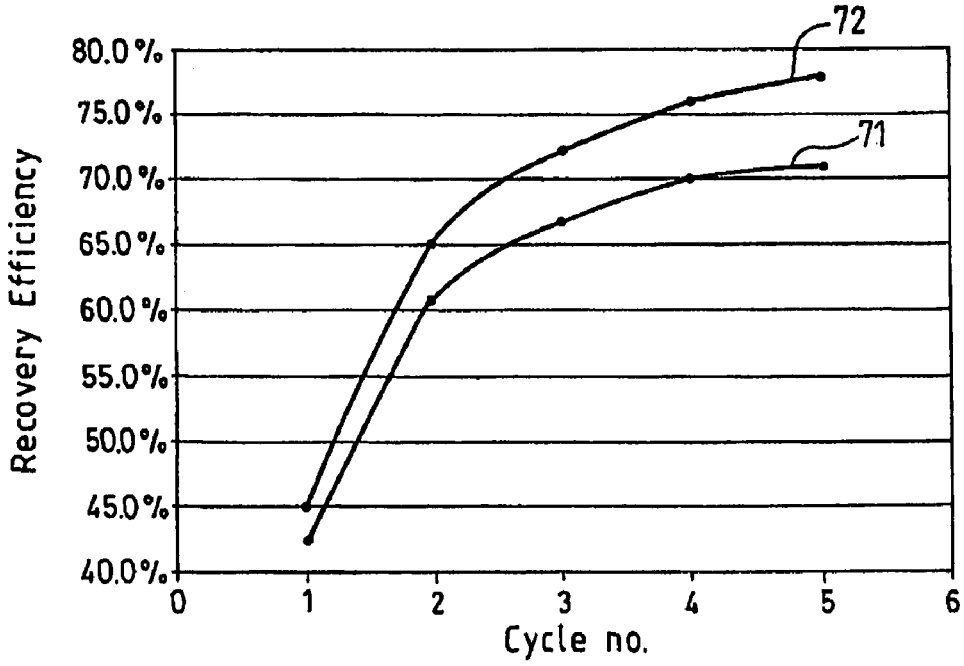
FIG. 7*b* contains an example plot for a recovery efficiency parameter illustrating an improvement achieved by the invention.

FIG. 7*b* contains an example curve 72 illustrating the improvement of the recovery efficiency when using a system as described in relation to FIG. 6 and FIG. 7, as compared to the curve 71 that is obtained using a system known from prior art. The curve 71 is explained in FIG. 3 and corresponds to a water storage system having a single screen. The recovery efficiency increases from about 42% to 70% after 5 cycles and thereafter the recovery efficiency is plateauing. The curve 72 starts with a higher efficiency of 45% at the first cycle, increases to an efficiency of about 78% at the fifth cycle, and continues to increase. It may be noted that a recovery efficiency greater than 70% is reaches several cycles earlier than in prior art.

In the present example embodiment, only three screens are provided. In another example embodiment, a different number of screens may be provided.

Referring again to FIG. 6, the closing of the screens in an order going from the deepest screen 61*c* towards the surface may be performed for example using a vertically moveable plug 68 that seals a portion of the well located on a deeper side of the plug 68, i.e. below the plug 68. The screens that are located below the plug 68 are isolated from the pump and no longer contribute to extract water. Operating means 69 allow to catch and move the plug 68. Each time the TDS content reaches the predefined threshold, the plug 68 is moved upward, and positioned above the next encountered screen. It is understood that other example embodiments of the plug 68 may be considered, for example an embodiment in which the plug comprises its own positioning means.

Figure 8:
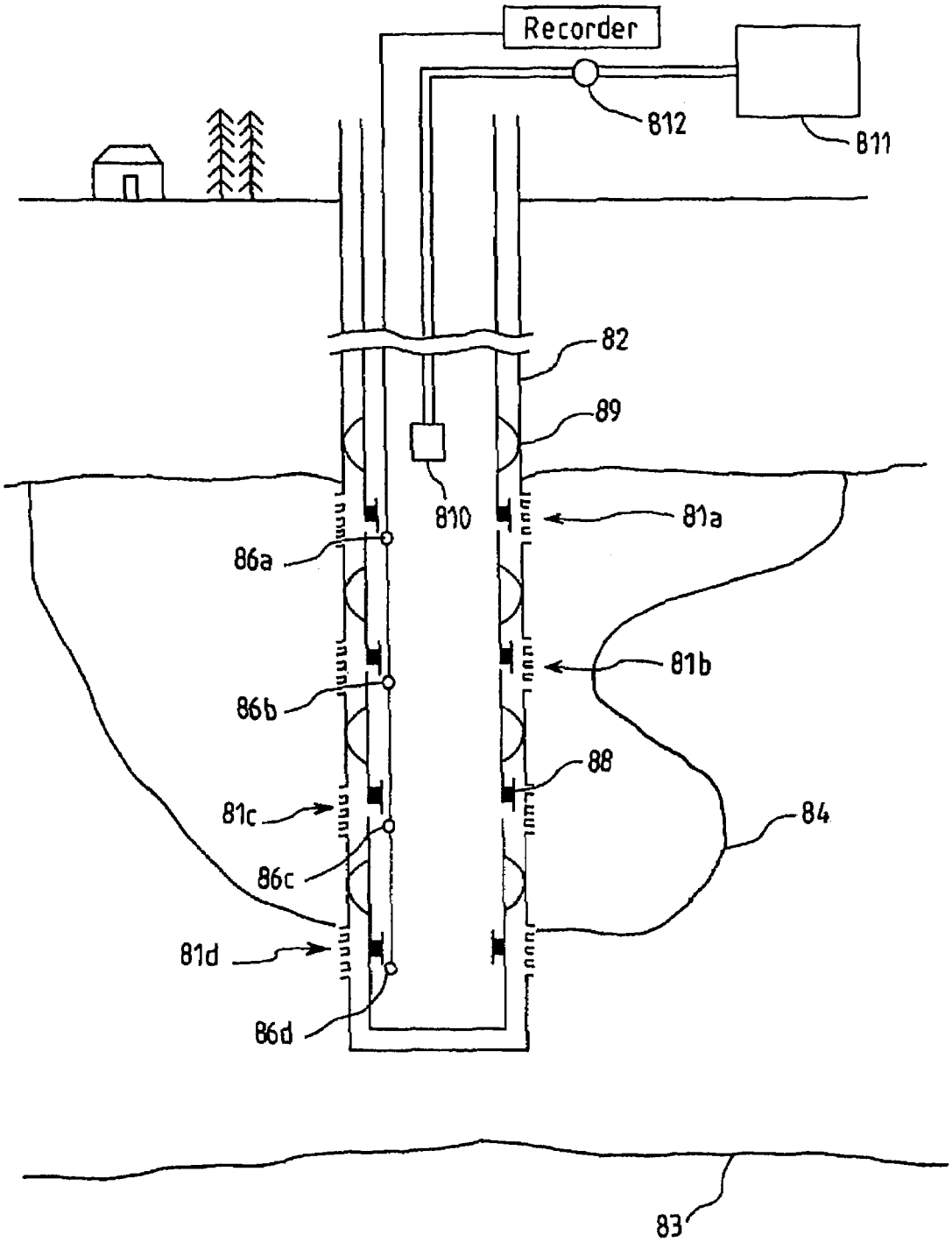
FIG. 8 contains a schematic diagram illustrating an example embodiment of a water storage system comprising a single well according to the invention.

FIG. 8 illustrates a third example embodiment of the present invention. A plurality of screens 81*a*, 81*b*, 81*c*, 81*d* are arranged along a longitudinal direction of a well 82. Each screen respectively allows the flow of fresh water between a base reservoir 811 and a storage zone that is associated with the screen. The base reservoir 811 is located at surface.

The fresh water may be extracted from an aquifer 83 with an extraction pump 810.

In this example embodiment, the storage model takes into consideration that a zone of fresh water 84 surrounding the well 84 has a shape that may have unexpected variations in size in a horizontal direction depending on the considered depth. It no longer has a symmetric shape as in the example described in relation to FIG. 6. The unexpected variations may be due for example to a fact that the injected water and the brackish water have different densities, that there are non porous bodies in the aquifer, or to any other reason.

The flow of liquid through each screen 81*a*, 81*b*,81*c*,81*d* is controlled using the storage model: for each storage zone corresponding respectively to a screen 81*a*, 81*b*, 81*c*, 81*d*, the TDS content is measured and the flow of liquid from each storage zone through the associated screen is allowed only if the corresponding TDS content is lower than the pre-determined threshold. Alternatively the flow of liquid may be allowed if the corresponding TDS content lies within a pre-defined range. Since the storage model foresees variations of the TDS content with depth of the storage zone of fresh water, the flow of liquid through each screen is individually controlled via the TDS content that is locally measured.

Sensors 86*a*, 86*b*, 86*c*, 86*d* are respectively mounted in proximity of the screens 81*a*, 81*b*, 81*c*, 81*d* to measure the TDS content. The sensors 86*a*, 86*b*, 86*c*, 86*d* may be located inside the well 82 as represented in the figure, but may also be located outside the well 82 in another example of embodiment. Thus each sensor 86*a*, 86*b*, 86*c*, 86*d* measures and monitors the TDS content of the water flowing through the corresponding screen 81*a*, 81*b*, 81*c*, 81*d* from the associated storage zone. When the TDS content at one of the sensors reaches the pre-defined threshold value, the screen corresponding to the sensor is closed to prevent the water from flowing through that screen.

Each screen 81*a*, 81*b*, 81*c*, 81*d* may be opened and closed using access means 88 that individually control the flow of liquid.

Assuming now for example a shape of the zone of fresh water 84 as represented in FIG. 8, the access means 88 of screen 81*d* close the screen 81*d* to stop brackish water from flowing through the screen 81*d*.

As the fresh continues to be extracted, the zone of fresh water 84 shrinks. The sensor 86*b* located next to the screen 81*b* monitors the TDS content from water flowing through the screen 81*b* and measures a TDS content that reaches the predefined threshold value. As a consequence, the screen 81*b* is closed using its access means 88. Following the closing of the screen 81*b*, the water may continue to flow through the screens 81*c* and 81*a* only.

The possibility of closing each screen individually is achieved by packers 89 that isolated adjacent screen from each other, and prevent water from a storage zone located near to a determined screen to be admitted through a screen adjacent to the determined screen.

The access means 88 that actually physically close the screen may for example be realized using a valve mechanism. Advantageously the valve mechanism may allow to adjust a flow rate of liquid flowing through a screen.

The storage model as described for the second example embodiment, which takes into consideration only the fact that the fresh water has a smaller density than the brackish water, may not provide an optimal recovery efficiency with a particularly shaped zone of fresh water as described in relation to FIG. 8. If the storage model as described for the second example is applied to the example of FIG. 8, then a detection of TDS content exceeding the predefined threshold value at the level of the screen 81*b* leads to the closing of the screen 81*b* and all the screens located below the screen 81*b*, i.e. 81*c* and 81*d*.

In a preferred embodiment of the second example, a general sensor 812 is provided at surface to monitor and measure the TDS content over the extracted water at the surface. The sensor 812 enables to guarantee that the extracted water is drinkable water.

In a further preferred embodiment of the second example, a recorder 811 records events such as the closing of one screen. Such recording enables a better modelling of the geological formation.

In yet another preferred embodiment, the TDS content is measured using the sensor 812 only instead of using sensors 86*a*, 86*b*, 86*c*, 86*d*. The flow of liquid through each screen 81*a*, 81*b*, 81*c*, 81*d* remains individually controllable. When the measured TDS content reaches the pre-defined threshold value, the storage model is used to select the screen to be closed.

In yet a further embodiment, a plurality of sensors 86*a*, 86*b*, 86*c*, 86*d* may be provided, for measuring the TDS content at the level of storage zones in proximity of the screens. The flow of liquid between the base reservoir and each storage zone may be controlled using a vertically movable plug that isolates the screens located below the plug. The storage model may take into consideration the difference of the densities between the injected fresh water and the brackish water: when the TDS content measured by one of the sensors reaches the pre-defined threshold, the plug is moved upward. The screens that are located below the plug are isolated. The flows of liquid from the determined zones of the screens located below the plug are no longer enabled.

Figure 9:
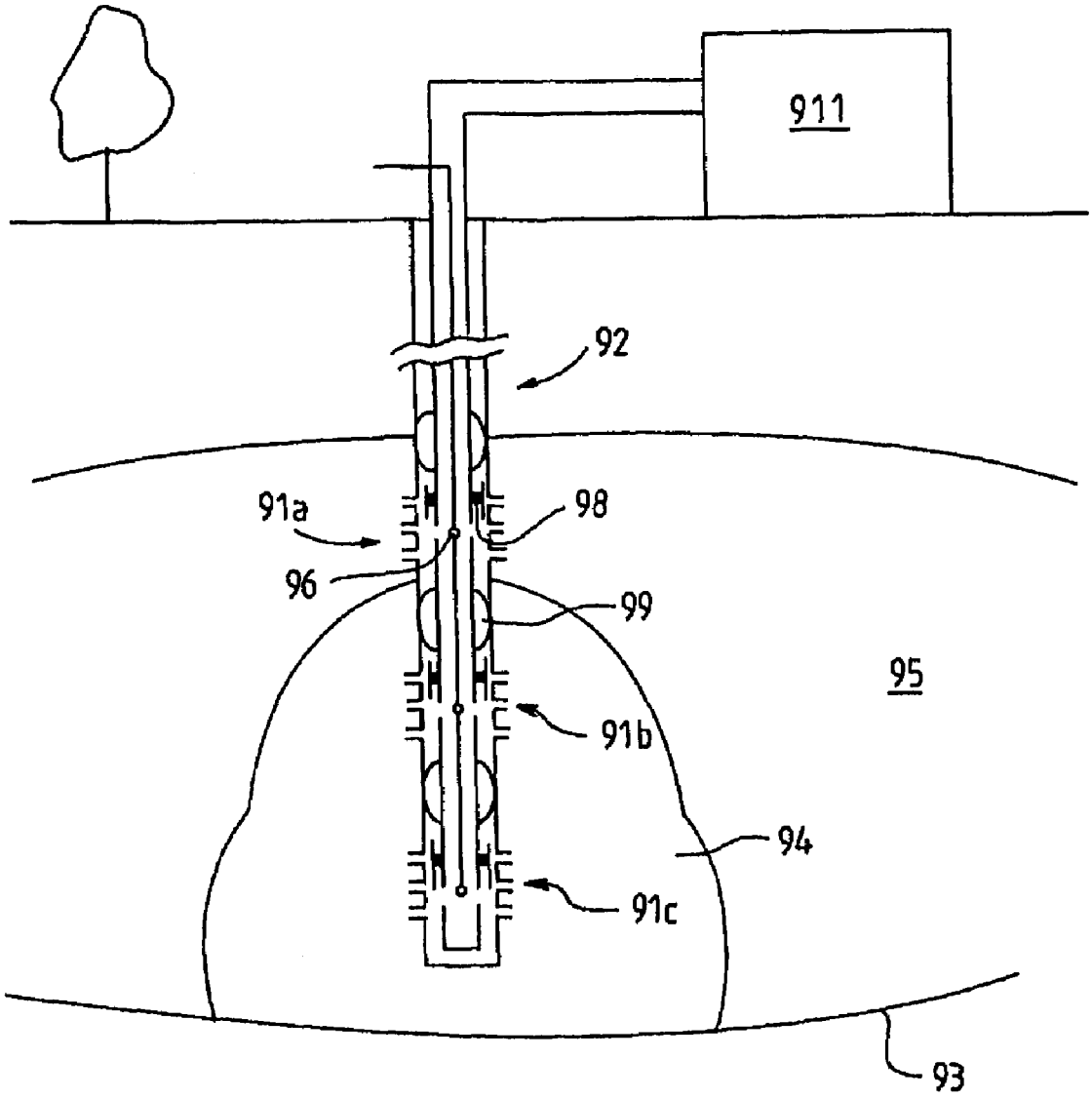
FIG. 9 contains a schematic diagram illustrating an example embodiment of a water storage system comprising a single well according to the invention.

FIG. 9 illustrates a fourth example embodiment of the present invention. A plurality of screens 91*a*, 91*b*, 91*c* is arranged along a longitudinal axis of a well 92. Each screen 91*a*, 91*b*, 91*c* respectively allows the flow of liquid between a base reservoir 911 and a storage zone that is associated with the screen.

Fresh water is injected into an aquifer 93, according to the storage model. In this embodiment, the storage model takes into consideration the fact that the injected fresh water has a smaller density than brackish water 95. Hence the storage model takes into consideration a tendency of the zone of fresh water 94 to float on the brackish water 95. Accordingly the fresh water is at first injected through the lowest screen 91*c* only, the other screens located above the screen 91*c* being closed.

After a determined delay, the screen 91*b* located above the screen 91*c* may be opened. This may be repeated for the screen 91*a* on the figure, or for further screens located above the screen 91*b* in an alternative embodiment. The delay may be determined by the storage model. Alternatively, the delay may also be determined using a plurality of sensors 96 measuring the TDS content. The sensors need to measure properties of liquid within the storage zone and are mounted as appropriate to the well. In this case, when the TDS content monitored and measured by one of the sensors sinks below the predefined threshold value, it is considered that the zone of fresh water has grown to an extend that it reaches the measuring sensor and hence the corresponding screen. The corresponding screen and the screens located below the corresponding screen are opened to allow injection of fresh water into the corresponding storage zone.

In a similar manner as in the example embodiment illustrated in FIG. 8, each screen is isolated from the adjacent screens using the packers 99. The flow rate through each screen may be controlled using a valve mechanism 98.

Multiple Well Configuration

Figure 10:
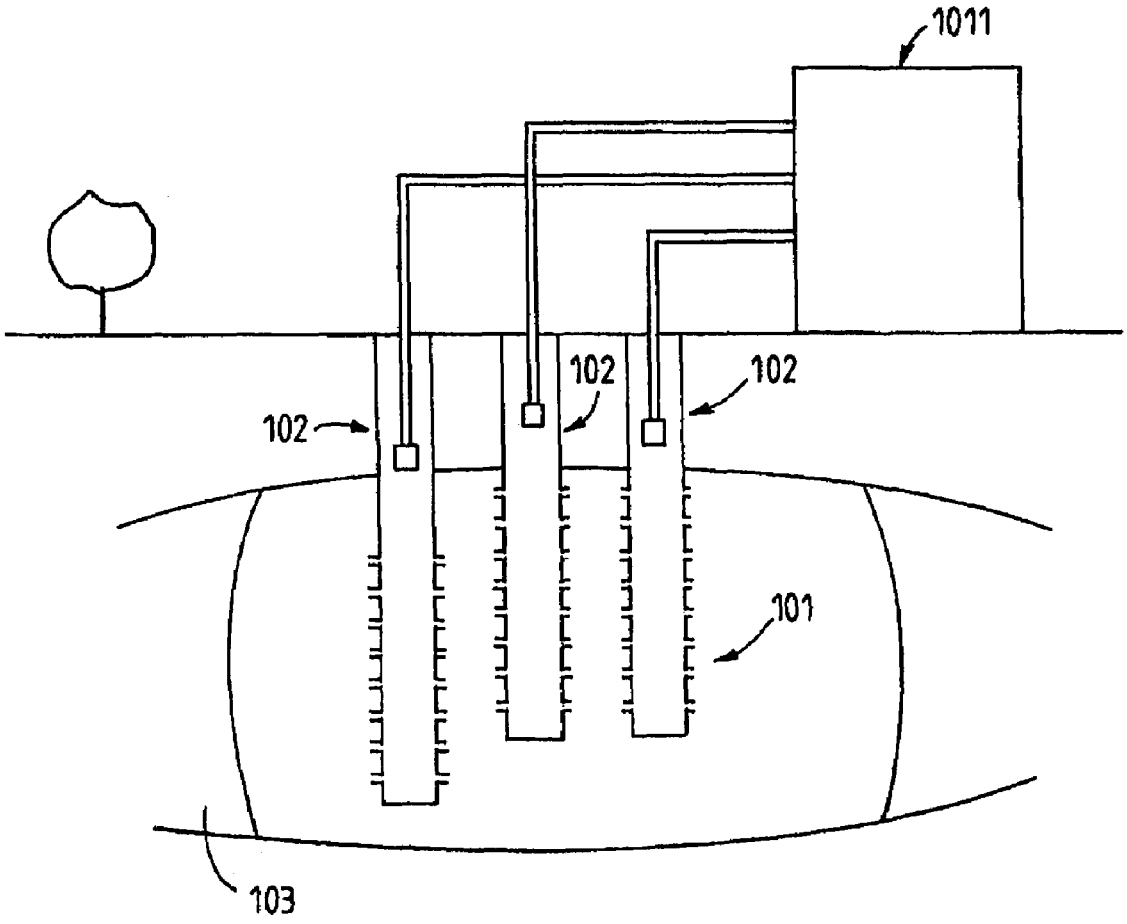
FIG. 10 contains a schematic diagram illustrating an example embodiment of a water storage system comprising multiple wells according to the invention.

FIG. 10 illustrates a fifth example embodiment of the present invention. In this embodiment, a plurality of wells 102 is provided, each well 102 having only one screen 101. Each screen allows the flow of fresh water between a base reservoir 1011 and a storage zone inside the aquifer 103 located around the respective screen.

The fresh water is injected through at least one of the screens 101. As has been described when discussing the prior art, the recovery efficiency of a water storage system based on a plurality of wells is relatively low when the liquid is injected and extracted through each screen independently of the other screens. This is because of the possibility of brackish water being trapped between the wells, and threatening to pollute the injected and stored fresh water.

The recovery efficiency of the plurality of wells may be increased by using an appropriate storage model to select each well individually when injecting or extracting fresh water. The storage model describes the behaviour of the fresh water in the storage zones and allows to correlate these behaviours.

Figure 11A:
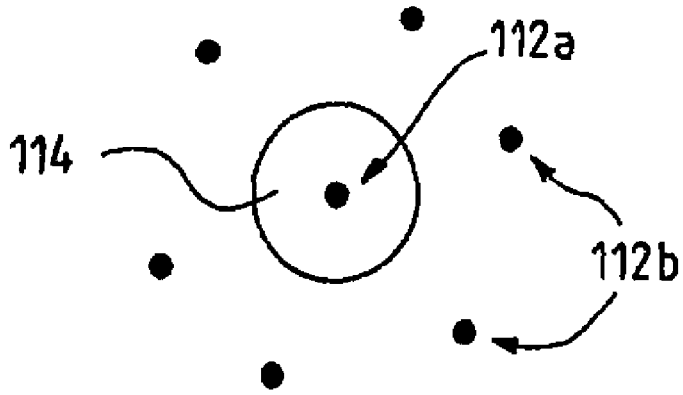
FIG. 11*a* contains a schematic upper view of an example multiple well water system according to the invention during an injection process.
Figure 11B:
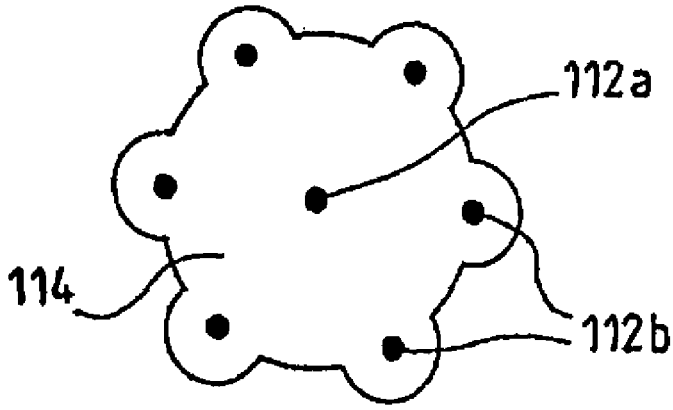
FIG. 11*b* contains a schematic upper view of an example multiple well water system according to the invention during an injection process.

FIG. 11*a* and FIG. 11*b* contain a view from above over a field of wells 112 during an injection process. The wells 112 are disposed in such a way to have one central well 112*a* and a plurality of peripheral wells 112*b*. A position and a distribution of wells may be defined by the storage model of the concerned aquifer depending on available storage zones in the aquifer and other aquifer or geological characteristics.

As is represented in FIG. 11*a*, fresh water is injected at first through the central well 112*a*. After a determined delay, fresh water is also injected through the peripheral wells 112*b*, creating a zone of fresh water 114 as shown in FIG. 11*b*

The determined delay may be derived using an appropriate storage model.

As an example, a delay may be derived using measurements of the quality of the water. In this case, a sensor (not shown in FIG. 11*a*) is respectively provided for each well 112*a* and 112*b*. Each sensor measures the TDS content for the storage zone corresponding to the screen of the concerned well. When the TDS content measured at one of the sensors of the peripheral wells 112*b* has a value below the pre-defined threshold value, it may be considered, according to the storage model, that the zone of fresh water 114 created in the aquifer has increased in size and reached the corresponding peripheral well 112*b*. Fresh water may then be injected from any one of the corresponding peripheral wells 112*b*. The method according to the invention allows to avoid the traps of brackish water known from prior art.

Similarly, the appropriate storage model may be used for the extraction of liquid. In a first step, the screens of the peripheral wells 112*b* are opened, and the water is extracted through the peripheral wells 112*b*. When the TDS content measured at one of the sensors of the peripheral wells 112*b* reaches the pre-defined threshold value, it is considered, according to the storage model, that the zone of fresh water 114 has shrunk and is then mainly concentrated around the central well 112*a*. The screens of the peripheral wells 112*b* are then closed, and the liquid is now extracted only from the central well 112*a*.

Alternatively, the screens of the peripheral wells 112*b* may also be closed after a delay that is evaluated using the storage model, e.g., a delay that corresponds to a predetermined amount of water extracted from the peripheral wells.

In a first alternative embodiment, a plurality of wells is provided, each well comprising a plurality of screens. The flow of liquid through each screen is individually controllable. The storage model may take into consideration variations of the shape of the zone of fresh water with depth, and with width, thus providing a more complete storage model.

Each well has at least one sensor that measures the quality parameter of the liquid. The quality parameter may be a Total Dissolved Salt contents, or any other pollution parameter.

One possible extraction exploitation of the first alternative embodiment provides to authorize extraction from the aquifer only from the peripheral wells in a first step. The lowest open screens of each peripheral well are closed one after the other, as the measured quality parameter increases and reaches the pre-defined threshold value. After the delay, the central well is also authorized to extract liquid.

In a second alternative embodiment, during extraction, a plurality of sensors is provided respectively for each well. Each sensor corresponds to one of the screens. In a first step, only the peripheral wells are authorized to extract water from the aquifer; and, when the TDS content measured at one of the sensors of one the peripheral wells reaches the predetermined threshold value, the corresponding screen is closed. After the delay, the central well is also authorized to extract liquid and the screens that are disposed on its longitudinal axis are controlled according to the measurements of the TDS content of the corresponding storage zones.

In the second alternative embodiment, the flow of liquid through each well is controlled, and so is the flow through each screen of each well, thus resulting in a 3D operational control of the extraction process. The 3D operational control may of course also be performed for an injection process.

The examples described in this specification generally show wells in a substantially vertical position. It is understood that the well may well be in a different deviated direction rather than being vertical. A deviated well may be used in order to take into consideration a particular geological structure. This applies to all examples described in this specification.

It is understood that the TDS quality parameter is frequently used as an example in the present description but that any other quality parameter may be used instead or in combination. Also the quality parameter is often compared to a threshold in the present description but may alternatively be compare to a range of values.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A method for improving the recovery efficiency of storing fresh water into an aquifer using a storage model of the aquifer, the storing comprising injecting the fresh water and extracting injected fresh water by a single water storage system comprising at least one well penetrating the aquifer, the method comprising:

controlling a plurality of screens, each of the plurality of screens being located alongside a wall of the at least one well, and each of the plurality of screens respectively allowing a flow of fresh water between an associated storage zone in contact with the screen and the at least one well on which the screen is located;

determining, in the storage model, a behavior of each associated storage zone using a plurality of geological characteristics of the aquifer;

receiving data from a plurality of sensors, wherein each of the plurality of sensors measures and monitors a quality parameter of water at one of the plurality of screens;

determining that the quality parameter of water has reached a predetermined threshold using at least one sensor of the plurality of sensors;

using the storage model to simulate an interaction between the injected fresh water and native water from each associated storage zone using the behavior of each associated storage zone, the data received from the plurality of sensors, and the quality parameter that has reached the predetermined threshold;

determining, based on the interaction, that the flow of fresh water from one or more screens of the plurality of screens should be modified to maintain or improve produced water quality of the at least one well; and adjusting the one or more screens to maintain or improve the produced water quality of the at least one well.

2. The method according to claim 1, wherein the single water storage system comprises only one well penetrating the aquifer.

3. The method according to claim 2, further comprising:

extracting the fresh water from the aquifer;

monitoring the quality parameter of the extracted fresh water at an exit of the single well;

following determining that the flow of fresh water from the one or more screens should be modified, selecting an additional screen, wherein the additional screen is the deepest screen alongside the single well allowing the flow of fresh water among the plurality of screens;

closing the additional screen to stop the flow of fresh water through the additional screen.

4. The method according to claim 3, wherein the quality parameter is a total dissolved salt parameter.

5. The method according to claim 2, further comprising:

extracting the fresh water from the aquifer;

monitoring the quality parameter of the fresh water at each screen of the plurality of screens using the plurality of sensors;

following determining that the flow of fresh water from the one or more screens should be modified selecting an additional screen, wherein the additional screen corresponds to a location alongside the single well at which the quality parameter reaches the predetermined threshold;

adjusting the additional screen to modify the flow of fresh water through the additional screen.

6. The method according to claim 5, further comprising:

activating a closing mechanism at the additional screen to stop the flow of fresh water through the additional screen.

7. The method according to claim 6, wherein the quality parameter is a total dissolved salt parameter.

8. The method according to claim 5, wherein the quality parameter is a total dissolved salt parameter.

9. The method according to claim 2, further comprising:

injecting the fresh water into the aquifer through the one or more screens, the one or more screens being located as the deepest of the plurality of screens alongside the single well;

monitoring the quality parameter of liquid at an outside part of each screen of the plurality of screens distinct from the one or more screens, the outside part being in contact with a storage zone;

selecting an additional screen among the plurality of screens following identifying the screen, the additional screen being distinct from the one or more screens, and the additional screen corresponding to a location alongside the single well at which the quality parameter reaches the predetermined threshold;

adjusting the additional screen to modify the flow of fresh water through the additional screen.

10. The method according to claim 9, wherein the quality parameter is a total dissolved salt parameter.

11. The method according to claim 2, wherein the quality parameter is a total dissolved salt parameter.

12. The method according to claim 1, further comprising:

providing the at least one well;

providing at least one peripheral well, the at least one peripheral well being distinct from the at least one well;

providing at least one screen from the plurality of screens for respectively each one of the at least one well and the at least one peripheral well.

13. The method according to claim 12, further comprising:

injecting the fresh water into the aquifer through a screen located alongside the at least one well;

monitoring the quality parameter of liquid at an outside part of each screen located on the at least one peripheral well, the outside part of each screen being in contact with a storage zone;

following determining that the flow of fresh water from the one or more screens should be modified, selecting an additional screen at which the quality parameter reaches the predetermined threshold;

injecting the fresh water into the aquifer through the at least one peripheral well on which the additional screen is located.

14. The method according to claim 13, wherein the quality parameter is a total dissolved salt parameter.

15. The method according to claim 12, wherein the quality parameter is a total dissolved salt parameter.

16. The method according to claim 1, wherein the quality parameter is a total dissolved salt parameter.

17. The method according to claim 1, further comprising:

injecting the fresh water into the aquifer;

extracting the fresh water from the aquifer;

the determining that the flow of fresh water from the one or more screens of the plurality of screens should be modified and the adjusting being performed such as to keep the quality parameter of the fresh water being extracted in a desired range;

interrupting the extracting of the fresh water when the quality parameter is outside of the desired range.

18. The method according to claim 17, wherein the injecting, the extracting and the interrupting are repeated in at least one cycle following the interrupting.

19. The method according to claim 18, wherein the interrupting comprises selectively interrupting the extracting from one determined storage zone of the aquifer when the quality parameter from the fresh water extracted out of the determined storage zone is outside the desired range.

20. The method according to claim 17, wherein the interrupting comprises selectively interrupting the extracting from one determined storage zone of the aquifer when the quality parameter from the fresh water extracted out of the determined storage zone is outside the desired range.

21. The method of claim 1 wherein adjusting the one or more screens is affected by changing a position of a seal inside the well in the proximity of the one or more screens.

22. The method of claim 1 wherein adjusting the one or more screens is affected by changing a position of a plug inside the well in the proximity of the one or more screens.

23. The method of claim 1 wherein adjusting the one or more screens is affected by changing a flow connection inside the well in the proximity of the one or more screens.

* * * * *

UNITED STATES PATENT AND TRADEMARK OFFICE

CERTIFICATE OF CORRECTION

PATENT NO. : 7,699,561 B2
APPLICATION NO. : 10/561640
DATED : April 20, 2010
INVENTOR(S) : Dominic McCann et al.

It is certified that error appears in the above-identified patent and that said Letters Patent is hereby corrected as shown below:

In Claim 5, Column 13, Line 24, the word "modified" should read --modified$_2$--.

Signed and Sealed this

Third Day of August, 2010

David J. Kappos

David J. Kappos
*Director of the United States Patent and Trademark Office*